United States Patent [19]

Frank et al.

[11] Patent Number: 5,052,730

[45] Date of Patent: Oct. 1, 1991

[54] LOCKING MEANS FOR A GATE IN AN AUTOMATIC TELLER MACHINE

[75] Inventors: Bruno Frank, Ehningen; Ulrich Hengstler, Schoenaich, both of Fed. Rep. of Germany

[73] Assignee: International Business Machines Corp., Armonk, N.Y.

[21] Appl. No.: 471,089

[22] Filed: Jan. 26, 1990

Related U.S. Application Data

[62] Division of Ser. No. 264,334, Oct. 28, 1988, Pat. No. 4,949,651.

[30] Foreign Application Priority Data

Nov. 7, 1987 [DE] Fed. Rep. of Germany ..... 3737882

[51] Int. Cl.[5] ..... E05B 47/00

[52] U.S. Cl. ..... 292/201; 49/41; 49/280; 49/291; 109/24.1; 292/DIG. 62

[58] Field of Search ..... 292/201, 224, 197, 200, 292/341.16, DIG. 62; 109/66, 24.1; 49/32, 139, 39, 41, 280, 286, 291

[56] References Cited

U.S. PATENT DOCUMENTS

| | | | |
|---|---|---|---|
| 2,586,847 | 2/1952 | Mead | 292/201 X |
| 3,861,727 | 1/1975 | Froerup et al. | 292/341.16 |
| 3,899,906 | 8/1975 | Bradstock | 292/200 X |
| 4,063,520 | 12/1977 | Parsons | 109/66 |
| 4,466,357 | 8/1984 | Masachika | 109/66 |
| 4,766,292 | 8/1988 | Cone | 235/22 |
| 4,794,733 | 1/1989 | Kanemaru | 49/348 |
| 4,911,488 | 3/1990 | Brackmann et al. | 292/201 X |

*Primary Examiner*—Richard E. Moore
*Attorney, Agent, or Firm*—Perman & Green

[57] ABSTRACT

A closure locking device for the opening of a self-service device, in particular an automatic teller machine includes a locking flap, the outside of which is indented. The locking flap, pivotable about an axis, is positioned behind a projecting upper wall panel and in front of a recessed wall panel. A gap is created when the locking flap is pivoted, and as the flap opens the width of the gap increases, so that any ice formed is broken up or jammed objects are released. A self-locking latch and actuator for the locking flap uses an actuating lever which is pivotable about an axis. The actuating lever includes a shaped guide slot which is engaged by the actuator. In a first part of the guide slot, no displacement work is performed by the actuator, whereas in a second part, which is positioned at an angle to the first part, displacement work is performed to move the lever and locking flap.

5 Claims, 4 Drawing Sheets

LOCKING MEANS FOR A GATE IN AN AUTOMATIC TELLER MACHINE

This is a divisional of copending application, U.S. Ser. No. 07/264,334, filed Oct. 28, 1988, now U.S. Pat. No. 4,949,651.

FIELD OF THE INVENTION

The invention concerns a locking means for an opening in the wall of a self-service device, in particular for a dispensing or deposit gate of an automatic teller machine. The invention also concerns a self-locking latch and actuator means for pivoting a movable component to one of two positions, in particular for actuating a locking means of a self-service device.

BACKGROUND OF THE INVENTION

A problem with self-service devices, such as cash terminals and automatic teller machines, is that they are not only installed in the lobby of, say, banks, but that they may also be installed in a place which is unprotected from the weather. In such a case, the device is exposed to extreme climatic conditions, such as rain, snow, cold and strong sunshine. Mechanical assemblies that must withstand such extremes both statically and kinematically are the locking means which releases or covers the dispensing gate and the locking means for the gate through which notes, cheques and the like are deposited.

Such units must be rain water repellent; must not freeze up; and must function even when the locking means becomes blocked by the formation of ice or as a result of vandalism. Existing cash terminals use locking means which do not meet the preceding requirements satisfactorily.

One prior art design comprises, for instance, a slotted cylinder which is supported on a plate provided with a slot. In the open position, currency is fed from the outside through a slot in the outer wall and an aligned slot in the cylinder. Water may enter through top and bottom joints between the cylinder and the outer wall. If a slot of relatively small size is used, serious problems may occur in high temperature ranges. A further disadvantage of this kind of seal is that the mechanism freezes up rapidly in the winter. Another serious disadvantage is that the mechanism may be blocked or jammed by inserted objects.

Another prior art design includes a plate, behind which a slide is arranged which, through the action of a gear and pinion, is shifted by a motor to close or release an opening in the plate. In this case the bottom joint between the slide and the outer plate is liable to cause problems, since it is here that water may enter or ice form. Even if the ice is smashed as the flap is opened by a suitably strong motor, fresh ice frequently forms when the flap is open, preventing it from closing reliably. The functioning of this design may be disrupted by objects jammed between the plate and slide as a result of vandalism.

It is an object of the present invention to design a locking means for an automatic teller machine such that the preceding problems are eliminated, and to substantially avoid and preclude the adverse effects produced by water, the formation of ice and jammed objects.

SUMMARY OF THE INVENTION

A locking means is disclosed whose design, over a wide range of installed positions, repels rain water and substantially avoids the formation of ice. Any ice which is formed, is broken up through the operation of the locking means. Furthermore, jammed objects do not prevent the opening of the locking means.

An aspect of the invention is a closure locking means for the opening of a self-service device, in particular an automatic teller machine, which includes a locking flap, the outside of which is indented. The locking flap, pivotable about an axis, is positioned behind a projecting upper wall panel and in front of a recessed wall panel. A gap is created when the locking flap is pivoted, and as the flap is opened, the width of the gap increases, so that any ice formed is broken up or jammed objects are released. A self-locking latch and actuator means for the locking flap uses an actuating lever which is pivotable about axis. The actuating lever includes a shaped guide slot, which is engaged by the actuator means. In a first part of the guide slot, no displacement work is performed by the actuator means, whereas in a second part, which is positioned at an angle to the first part, displacement work is performed to move the lever and locking flap.

DESCRIPTION OF THE DRAWINGS

A preferred manner for carrying out the invention is described in detail below with reference to drawings which illustrate a specific embodiment, in which.

DETAILED DESCRIPTION OF THE INVENTION

The essential components of the locking means of the invention are described in detail below with reference to FIGS. 1 to 3.

Figure 1:
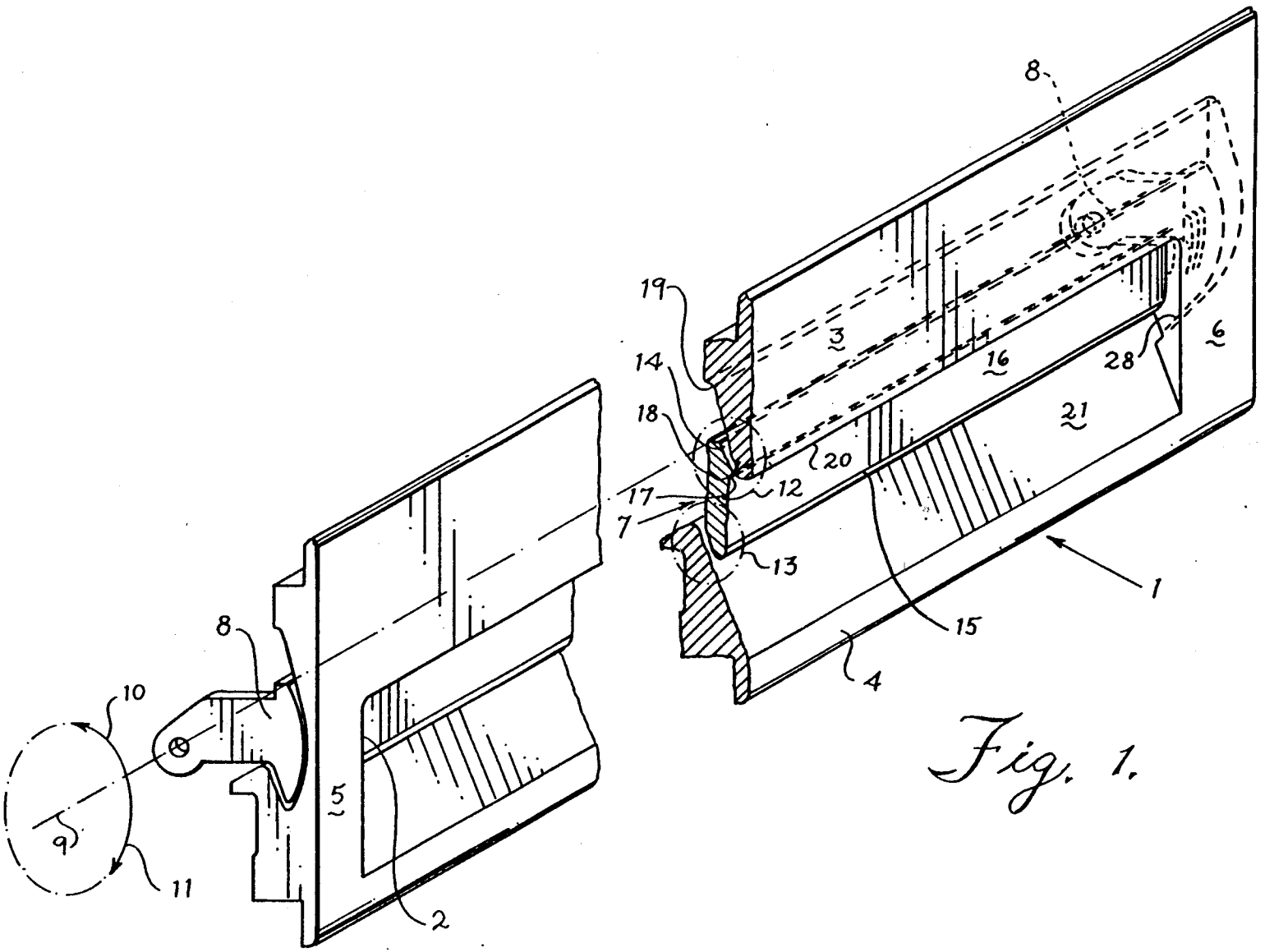
FIG. 1 is a schematic isometric, partly sectional view of the locking means according to the present invention.

FIG. 1 is a schematic isometric, partly sectional view of a locking means 1 according to the present invention. Locking means 1 includes an opening 2, a top front wall panel 3, a lower recessed wall panel 4 and two side elements 5 and 6 linking panels 3 and 4. The lower wall panel 4 tilts inward and is most recessed immediately adjacent to top front wall panel 3. A locking flap 7, mounted on two levers 8, is pivotable about an axis 9 extending parallel to wall panels 3 and 4. To open locking flap 7, it is pivoted upwards by a predetermined angular amount in the direction of arrow 10. It is closed by being pivoted downwards about axis 9 in the direction of arrow 11. Locking flap 7 is arranged in such a manner that when opening 2 is blocked, it is positioned partly behind upper front wall panel 3 (see in particular the encircled region 12) and partly in front of the lower recessed wall panel 4 (see the encircled region 13). In upper region 14, facing the outside, and in lower region 15 also facing the outside, locking flap 7 is substantially cylindrically shaped. Between regions 14 and 15, the outer surface of locking flap 7 is provided with a substantially planar recess or indentation 16. The transition between cylindrical region 14 and recess or indentation 16 is designed as a step 17.

To match the pivotal range of locking flap 7, inner face 19 of upper protruding wall panel 3 is inclined towards the top and the inside, with a gap 18 being formed between locking flap 7 and inner face 19. As a result, a nose-shaped projection is formed in the region of lower edge 20 of the upper front wall panel above the transition between the cylindrical region 14 and substantially planar recess 16 with its step 17. When the locking flap 7 is opened by being pivoted upwards in the direction of arrow 10, the width of gap 18 between the outer elements of the locking flap 7 and inner face 19 of upper front wall panel 3 increases continually. The great advantage of this is that any ice formed in gap 18 is broken up and that jammed objects are not pulled farther inside the gap but are released, to be removed as the width of the gap increases. As may be seen from FIG. 1 and the sectional arrangement of FIG. 3, lower edge 20, forming a nose-shaped projection above outer top region 14 of locking flap 7, and lower region 15 of locking flap 7, protruding over recessed wall panel 4, effectively repel any ingress of water.

To reliably seal locking flap 7 and outer surface 21 of the lower recessed wall panel, the shape of inner surface 22 of the lower portion of locking flap 7 is matched to outer surface 21 of wall panel 4, which extends downwards towards the outside. The structure is such that the bottom-most edge 23 is bound to come to rest against outer surface 21, so that reliable sealing is ensured in the extreme inclined position of about 25°, as shown in the left bottom position in FIG. 3.

Figure 2:
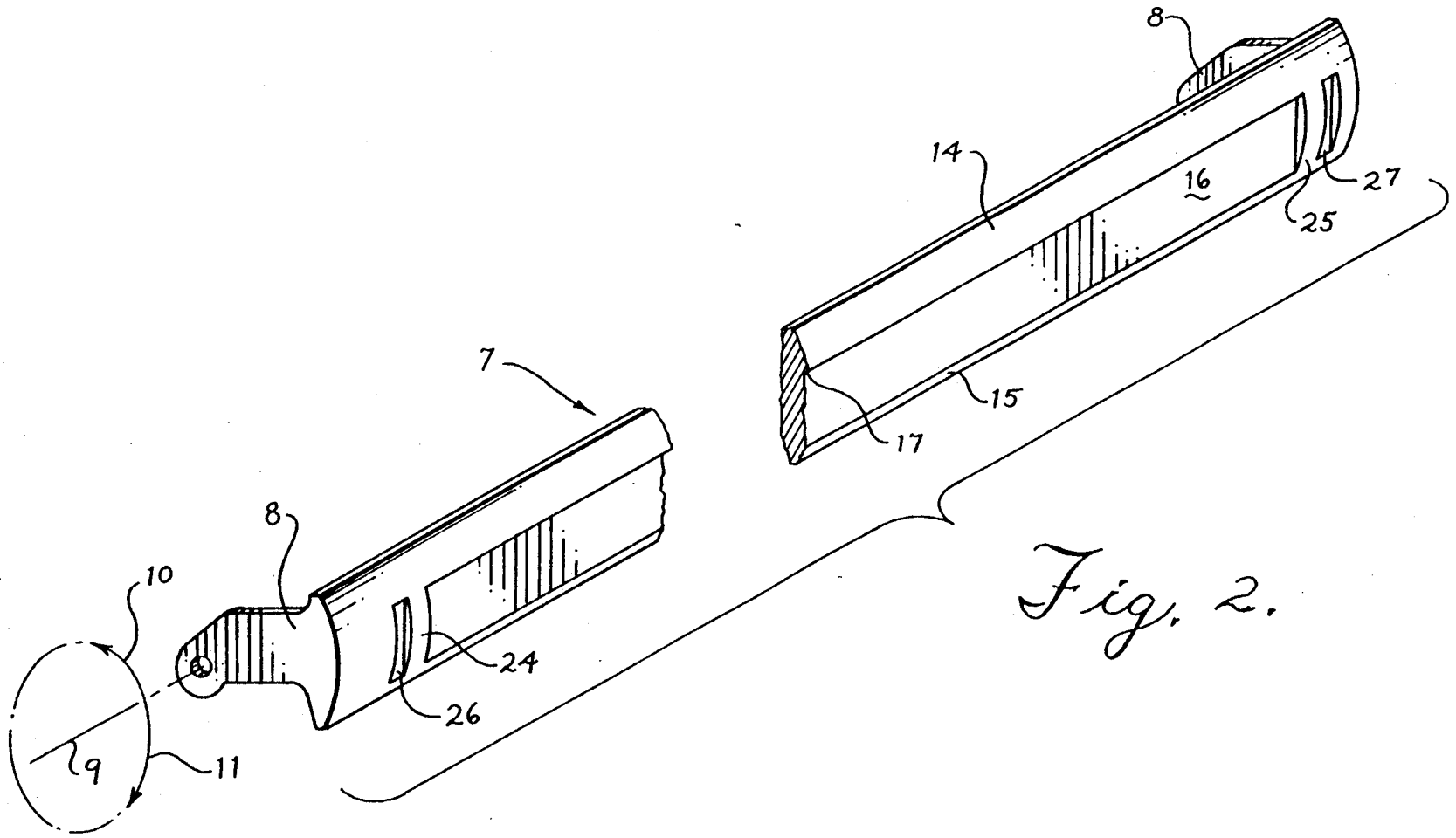
FIG. 2 is a schematic isometric, partly sectional view of the locking flap designed according to the invention.

FIG. 2 is a schematic isometric, partly sectional view of locking flap 7 without wall panels 3 and 4 and side elements 5 and 6. It may be seen that substantially planar recess or indentation 16 is positioned in the region of opening 2 (FIG. 1). To prevent any ingress of water in the regions below the side elements 5 and 6, locking flap 7 is provided with cylindrically shaped side elements 24 and 25 in those regions. Vertical grooves 26 and 27, respectively, are provided on the outboard sides of elements 24 and 25. By means of these grooves, any water entering via the cylindrical side elements 24 and 25 is discharged downwards. Such water is also discharged by small channels 28 (FIG. 1) provided in the side elements. As may be seen from FIG. 3, the side elements, in particular the inner portion of side elements 5 and 6 (see element 6, shown in FIG. 3 on the right), are substantially cylindrically shaped, thus mating with and sealing to cylindrically shaped elements 25 and 24, respectively, of locking flap 7.

Figure 3:
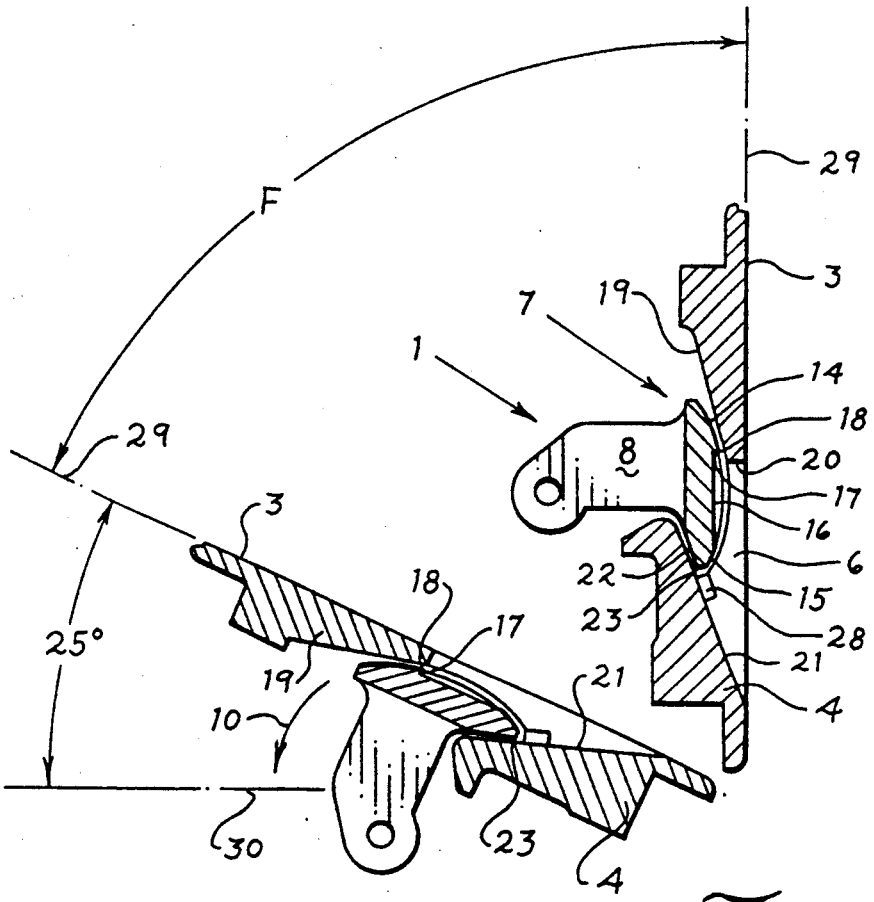
FIG. 3 is a schematic sectional view of the locking means in two of its possible installation positions.

With regard to FIG. 3, it has been mentioned that the wall-mount position is shown on the right. In that position, the face of locking means 1 is perpendicularly arranged, however it may be tilted to up to 25° from horizontal line 30, giving a functional range F. This second position is shown on the left in FIG. 3. In the illustrated example, the slope of outer surface 21 of lower recessed wall panel 4 is such that any fluid, such as rain water, is still reliably discharged.

The lower built-in position of FIG. 3 illustrates a further essential advantage of the locking means. If, for example, wind drives water from right to left, that position would be the most susceptible to leakage. As lower edge 23 of locking flap 7 rests against outer surface 21 of lower recessed wall panel 4 (not shown in the drawing), the lower region is reliably sealed. In addition, step 17 prevents any wind-driven water from entering the upper region of gap 18. It is clearly shown that when locking flap 7 is pivoted in the direction of arrow 10, gap 18 increases between inner face 19 of upper front wall panel 3 and locking flap 7.

As a result, any ice formed in gap 18 is broken up and jammed objects are automatically released.

A self-locking latch and actuator means 31 for pivoting a component to one of two positions will now be described with reference to FIGS. 4 to 8. The component to be pivoted is locking flap 7 of locking means 1 (shown in greater detail in FIGS. 1 to 3).

The actuator used to pivot component 7 is a reversible geared electromotor 32. A drive arm 34 is arranged on driven shaft 33 of motor 32. A pin 35 is fixed to the end of drive arm 34. When arm 34 is actuated, pin 35 moves along an arc 36. Pin 35 is fitted into a slot 37 provided in an actuating lever 38. Actuating lever 38 is pivotable about an axis 9. One side of lever 38 is engaged by the actuator through pin 35 in slot 37 and its other side is attached to pivotable component 7. Guide slot 37 is divided into two parts, 39 and 40. The first part 39 is designed such that its centerline lies substantially on arc 36 described by the movement pin 35. The advantage of this is that in the starting phase of motor 32, pin 35 is allowed to accelerate to the beginning of second part 40 of guide slot 37 while performing no displacement work on actuating lever 38.

Second part 40 of guide slot 37 is arranged relative to first part 39 at such an angle that pin 35 applies displacement force to the sides 41 and 42 of the second part 40 of guide slot 37 in a direction which is substantially perpendicular to pivotal radius 43.

Pivotal radius 43 represents a connecting line extending through pivot axis 9 of actuating arm 38 and substantially through the center of the locking flap 7 fixed thereto. The angle between first part 39 and second part 40 of guide slot 37 is chosen such that when actuating arm 38 is pivoted about its axis 9, the direction of force action is retained, i.e., it is substantially perpendicular to the pivotal radius 43. This force direction is retained until the displacement end position is reached. At the driving end of actuating lever 38, a component 44 is arranged which actuates a sensor 45 or 46 at its respective movement limits. The position of actuating lever 38 and pin 35 in guide slot 37, (FIG. 4), is the latched position. In this position, the opening between the wall panels 3 and 4 is closed by locking flap 7. If, for example, a force is applied to locking flap 7 in a direction from lower wall panel 4 to upper wall panel 3, the force action of the actuating lever 38 on pin 35 and its arm 34 is such that actuating lever 38 is prevented from moving.

Figure 4:
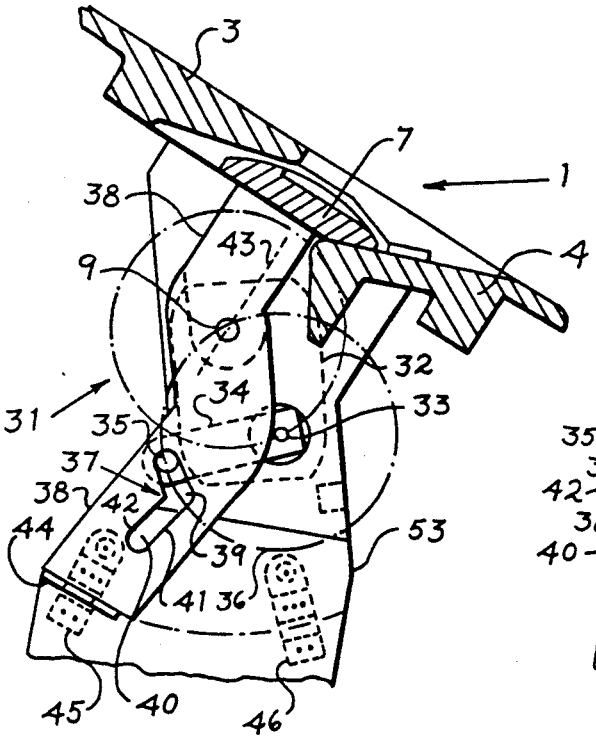
FIG. 4 is a schematic partly sectional side view of a self-locking latch and actuator means in accordance with the present invention.
Figure 5:
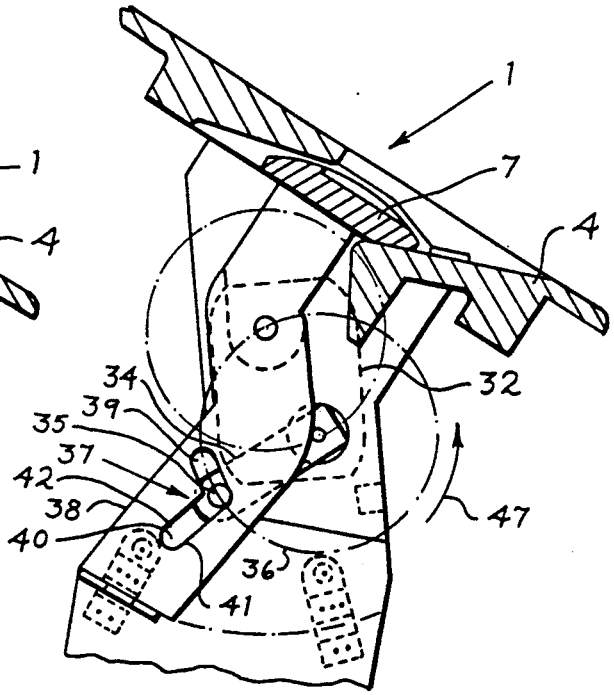
FIG. 5 shows the arrangement of FIG. 4 but in an intermediate position of the drive arm in which the opening is still closed but already unlatched.

FIG. 5 shows the same arrangement as FIG. 4, with actuator pin 35 assuming another position on arc 36 as a result of the pivotal motion of drive arm 34 of motor 32. This position is shown at the very point where parts 39 and 40 of guide slot 37 coincide. Pin 35 rests against side 41 of guide slot 37. As shown in FIG. 5, locking flap 7 is not yet removed from lower recessed wall panel 4. This means, that the opening, although still being closed is unlatched at this stage. As drive arm 34 with its pin 35 is moved further along arc 36 in the direction of arrow 47, actuating arm 38 is pivoted.

Figure 6:
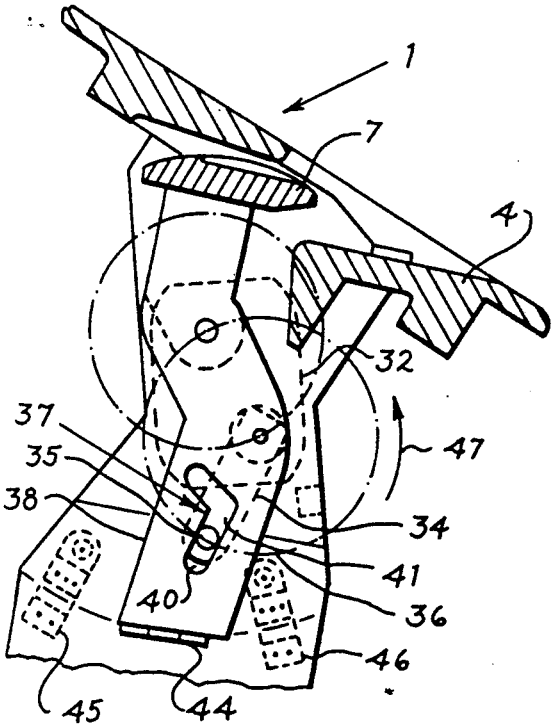
FIG. 6 shows the arrangement of FIG. 4 but in a further intermediate position in which half the opening of the locking means is opened.

FIG. 6 shows the same arrangement as FIGS. 4 and 5, but with the movable components assuming another position. Compared with FIGS. 4 and 5 and the sequence shown therein (from the latched to the unlatched position), FIG. 6 depicts pin 35 halfway along second part 40 of guide slot 37. For this purpose, pin 35, by being actuated by motor 32 and pivoting drive arm 34 in the direction of arrow 47, slides along arc 36 on side 41 of second part 40 of guide slot 37. In response, actuating lever 38 with its part 44, (for actuating the sensors), assumes a position roughly halfway between sensors 45 and 46. Subsequently, locking flap 7 is removed from lower wall panel 4, releasing half of the opening provided therein.

Figure 7:
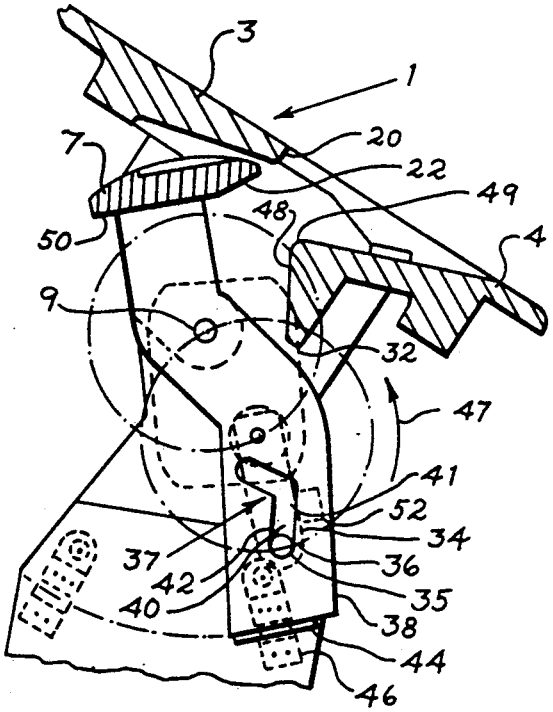
FIG. 7 shows the arrangement of FIG. 4 but in the unlatched and completely opened position.

The arrangement of FIGS. 4, 5 and 6 is again shown in FIG. 7, but in an end position opposite to that of FIG. 4. Compared with FIG. 6, motor 32 has moved pin 35 with its drive arm 34 further along arc 36 in the direction of arrow 47. As a result, pin 35 resides in the second part of guide slot 37 and has moved to the end of that part, with drive arm 34 coming to rest against stop 52. Stop 52 may be made of a flexible material, so that the end position is reached smoothly. The end position is detected by part 44 of actuating lever 38 and associated sensor 46. In that position, actuating lever 38, by being pivoted about axis 9, moves locking flap 7 to a position where it is at a maximum distance from recessed wall panel 4. As a result, an opening is formed between the inner face 22 of the lower portion of locking flap 7 and lower edge 20 of upper front wall panel 3 on the one hand and top edge 49 of lower recessed wall panel 4 on the other. Inner face 48 of lower wall panel 4 is inclined, and locking flap 7 is provided with a face 50 on its inside. These two faces 48 and 50 form a chute through which items to be released, such as bank notes or statements of account, are reliably passed to the outside.

The operation of the locking means from the latched and/or closed position to the unlatched and fully opened position has been described above in the order of FIGS. 4 to 7 and with reference to the movement of drive arm 34 in the direction of arrow 47. During that phase, pin 35, by force transfer, acts on side 41 of part 40 of guide slot 37. When motor 32 is started, this sequence may be reversed, so that pin 35, from the position shown in FIG. 7 acts on side 42 of part 40 of guide slot 37, pivoting the actuating lever 38 in a direction causing the locking flap to be moved downwards in a closing direction about pivotal axis 9. This movement continues until pin 35 has been restored to the position shown in FIG. 5, in which the opening is already closed but not yet latched. By pivoting pin 35 from the position of FIG. 5 to the position of FIG. 4, the locking means is again latched.

To ensure that the end positions are reliably reached, electromotor 32 is controlled such that its current, once it has reached an end position, is switched off only after a certain increase in current has been detected. This occurs whenever pin 35 encounters resistance at the end of part 39 or 40 of guide slot 37, such as when drive arm 34 comes to rest against flexible stops such as those designated as 52 in FIG. 7. Sensors 45 and 46, which are used to detect the respective end position may be, for example, photosensors.

The arrangement shown in FIGS. 4 to 7 is inclined relative to the horizontal. This inclination substantially corresponds to an ergonometrically satisfactory built-in position of about 30° to 35° to the horizontal. As a result, any items fed through the opening to the outside or placed therein for removal can be readily removed.

Figure 8:
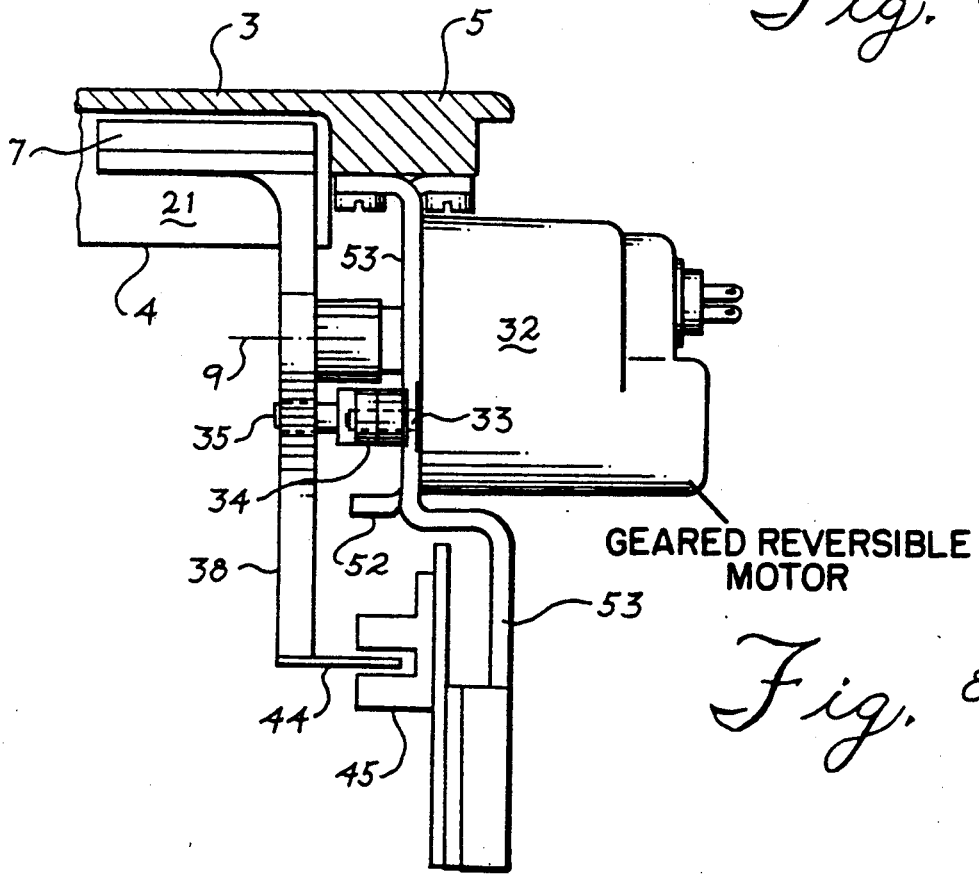
FIG. 8 is a schematic rear top view of the arrangement of FIG. 4.

FIG. 8 is a schematic rear top view of the arrangement shown in FIGS. 4 to 7. A carrier arm 53 is fixed to side element 5 which, as shown in particular in FIG. 1, links upper front wall panel 3 with lower recessed wall panel 4. Motor 32, whose shaft 33 moves drive arm 34 with pin 35 is fixed to carrier arm 53. Pin 35 is guided in guide slot 37 (not shown in FIG. 8). In response to the movement of pin 35 in the guide slot of actuating lever 38, the latter along with the attached locking flap is pivoted about axis 9. In addition to other components, not shown, sensor 45 is fixed to carrier arm 53. Component 44, arranged on the actuating lever 38, actuates sensor 45 in the respective end position. Carrier arm 53 is also provided with a stop 52 against which drive arm 34 rests in the full open position.

As can thus be seen locking means 1 enables water to be reliably repelled in different built-in positions. The formation of ice is either substantially avoided or any ice which is formed despite the indicated precautions, does not interfere with the operation of the locking means. This applies also to items that become jammed as a result of vandalism. The invention operates such that any jammed items are released as the width of the opening increases and they generally do not prevent the locking means from being opened. Needless to say, the power of the motor used for this purpose and the force at which an item is introduced into the flap are significant. The self-locking latch and actuator means has a simple design and may be used to particular advantage for the locking means according to the invention.

It should be understood that the foregoing description is only illustrative of the invention. Various alternatives and modifications can be devices by those skilled in the art without departing from the invention. Accordingly, the present invention is intended to embrace all such alternatives, modifications and variances which fall within the scope of the appended claims.

We claim:

1. Self-locking latch and actuator means for pivoting a component to either of two positions, with at least one position being latched, the combination comprising:

a geared reversible electromotor with a drive arm, said drive arm provided with a pin at one extremity thereof, said pin creating an arc of motion when said electromotor is engaged;

rotatable actuating lever mounted on an axis, said component mounted at one end of said lever, said lever provided with a guide slot which is engaged by said pin;

said guide slot having a first part with a centerline which lies substantially on said arc, whereby said pin moves freely in said first part when actuated by said electromotor but latches said component until so actuated; and said guide slot having a second part positioned at an angle to said first part such that said pin exerts a displacement force on said lever in a direction which causes said lever to pivot about its axis.

2. The means described in claim 1 wherein the displacement force exerted by said pin on said second part is substantially perpendicular to a line drawn between said axis about which said actuating lever is pivoted and the center of said pivotable component; and the angle between said first and second parts of said guide slot is such the direction of force exerted by said pin on said second part is retained until a displacement end position is reached.

3. A latch and actuator means according to claim 2, wherein said actuating lever is slightly S-shaped.

4. A latch and actuator means according to claim 3 further comprising:

sensors mounted to detect the end position of said actuating lever.

5. A latch and actuator means according to claim 4 further comprising:

means for switching off drive current to said electromotor only after an increase in current has been detected, thus ensuring that reliable end positions are reached.

* * * * *